US006073371A

United States Patent [19]

Goos et al.

[11] Patent Number: 6,073,371

[45] Date of Patent: Jun. 13, 2000

[54] SNOWPLOW ASSEMBLY WITH ADJUSTABLE-BIAS TRIP MECHANISM

[75] Inventors: Mary T. Goos, Masonville; Glen A. Galloway; Jeffery L. Jacobson, both of Manchester; Janet A. Kelley, Dyersville; Craig A. Mulder, Manchester; Terry L. Solomon, Manchester; Richard A. Nachtman, Manchester; Leslie L. Shaw, Manchester; Jeffrey D. Johnson, Earlville, all of Iowa

[73] Assignee: Henderson Manufacturing Company, Manchester, Iowa

[21] Appl. No.: 08/997,097

[22] Filed: Dec. 22, 1997

[51] Int. Cl.[7] ..... E01H 5/06

[52] U.S. Cl. ..... 37/232; 37/279; 37/407

[58] Field of Search ..... 37/232, 233, 235, 37/266, 270, 271, 279, 403, 407

[56] References Cited

U.S. PATENT DOCUMENTS

| | | | |
|---|---|---|---|
| 2,103,775 | 12/1937 | Frink | 37/279 X |
| 2,697,289 | 12/1954 | Standfuss | 37/232 |
| 3,626,614 | 12/1971 | Kahlbacher | 37/232 |
| 3,650,054 | 3/1972 | Hanson | 37/232 |
| 4,215,494 | 8/1980 | Farrell et al. . | |
| 5,109,618 | 5/1992 | Grübler et al. . | |
| 5,121,562 | 6/1992 | Feller . | |
| 5,191,729 | 3/1993 | Verseef . | |

OTHER PUBLICATIONS

Photograph of rear suspension of a 1991 Yamaha Virago 750 motorcycle (1991).

*Primary Examiner*—H. Shackelford
*Attorney, Agent, or Firm*—Leydig, Voit & Mayer, LTD.

[57] ABSTRACT

A vehicle snowplow system with an adjustable-bias tripping mechanism. The system includes a snowplow blade or moldboard which is pivotally mounted to a frame, the latter being adapted for mounting to a vehicle. The moldboard "trips" or pivotally moves between a normal plowing position and a displaced position when a lower region of the moldboard contacts a rigid obstruction. The system includes at least one biasing assembly operable to bias the moldboard toward the normal position with a biasing force, the biasing assembly configured so as to provide an adjustment to the biasing force to compensate for variances in roadway or environmental conditions.

6 Claims, 5 Drawing Sheets

SNOWPLOW ASSEMBLY WITH ADJUSTABLE-BIAS TRIP MECHANISM

BACKGROUND OF THE INVENTION

The present invention generally relates to snow plow assemblies and, more particularly, to snow plow assemblies that employ tripping mechanisms.

Snow plow assemblies are commonly mounted onto a variety of vehicles during winter months in an effort to efficiently remove snow from paths, sidewalks, roadways, and other areas. Vehicles onto which these assemblies may be mounted include garden and heavy-duty tractors, light-duty and heavy-duty trucks (such as those adapted to spread sand and salt), and maintenance vehicles such as "Bobcats." These assemblies commonly employ a blade or moldboard in a forward position. The moldboard is typically mounted onto a frame, with the frame in turn being mounted onto the front of the vehicle. As the vehicle moves forward, the moldboard contacts the snow and causes that snow to be displaced to one or both sides of the moldboard, thereby clearing the snow from the surface over which the moldboard passes. Examples of conventional snow plow assemblies are provided in U.S. Pat. Nos. 4,215,494, 5,109,618, 5,121,562, and 5,191,727.

During the plowing of snow, the moldboard is typically positioned so that its lower edge contacts and slides along, or is held just above, the road or other surface being plowed. Of course, roads, driveways, parking lots and other surfaces may be irregular, and may further contain protruding rocks, ice chunks, or other debris embedded therein. These irregularities potentially create problems, for when the lower edge of a moldboard strikes an irregularity or other immovable object, the force of the impact may damage the moldboard, the frame, or in some cases the vehicle itself. In order to protect the moldboard, frame assembly and vehicle from damage during use, it is known to mount the moldboard, or the lower portion thereof, pivotally so that the moldboard (or lower portion thereof) can "trip" or move when it strikes a rigidly fixed or immovable object, thus allowing the moldboard to pass over the object, and thereby hopefully avoiding any significant damage to the assembly. After the moldboard passes the object, a biasing force, typically provided by a spring, biases the moldboard back into its normal plowing position.

While various configurations have been employed for biasing a pivotable moldboard, the biasing force provided by many of these configurations is often not optimal for more than one set of operating conditions. This creates a problem when a vehicle is assigned to remove snow from a variety of surfaces, each having a different surface condition, or in changing environmental conditions. While there exist some snow plow assemblies that do provide for some degree of adjustment of a biasing force, these assemblies are complicated mechanically, and are not relatively easily and quickly adjustable by a vehicle operator after the vehicle leaves the garage. Thus, there exists a need for a snow plow assembly which overcomes the aforesaid and other problems associated with existing assemblies.

SUMMARY OF THE PRESENT INVENTION

The present invention meets the aforesaid and other needs by providing a snowplow assembly for a vehicle comprising a frame; a moldboard pivotally mounted to the frame for movement between a normal position and a displaced position; and at least one biasing assembly biasing the moldboard toward the normal position with a biasing force. The biasing assembly comprises a compressible biasing member having first and second ends; a first support member secured for movement with the moldboard; a second support member secured to the frame; and a rotatable collar supporting the first end of the biasing member and positioned between an associated one of the support members and the biasing member, the other support member supporting the second end of the biasing member. In the foregoing assembly, a pivoting movement of the moldboard away from the normal position causes a corresponding increase in compression of the biasing member, and movement of the rotatable collar relative to the associated support member varies the compression of the biasing member.

Additional features and advantages of the present invention will be apparent from the drawings and disclosure of the invention as set forth herein.

DETAILED DESCRIPTION OF THE PREFERRED EMBODIMENTS

Figure 1:
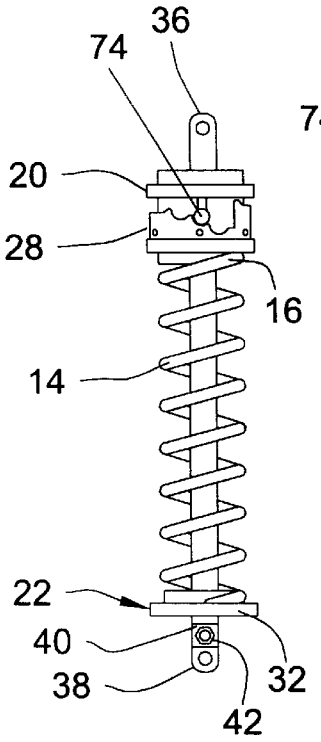
FIG. 1 is a side elevation view of a preferred biasing assembly for a snow plow assembly in accordance with a preferred embodiment of the present invention.

Turning to the drawings, wherein like numerals designate like parts, there is shown in FIGS. 1 and 2 one aspect of the present invention, a preferred embodiment of an adjustable biasing assembly 10. In accordance with another related aspect of the present invention, the biasing assembly 10 is shown integrated into a preferred snowplow assembly 12 in FIGS. 3, 4*a* and 4*b*.

Figure 3:
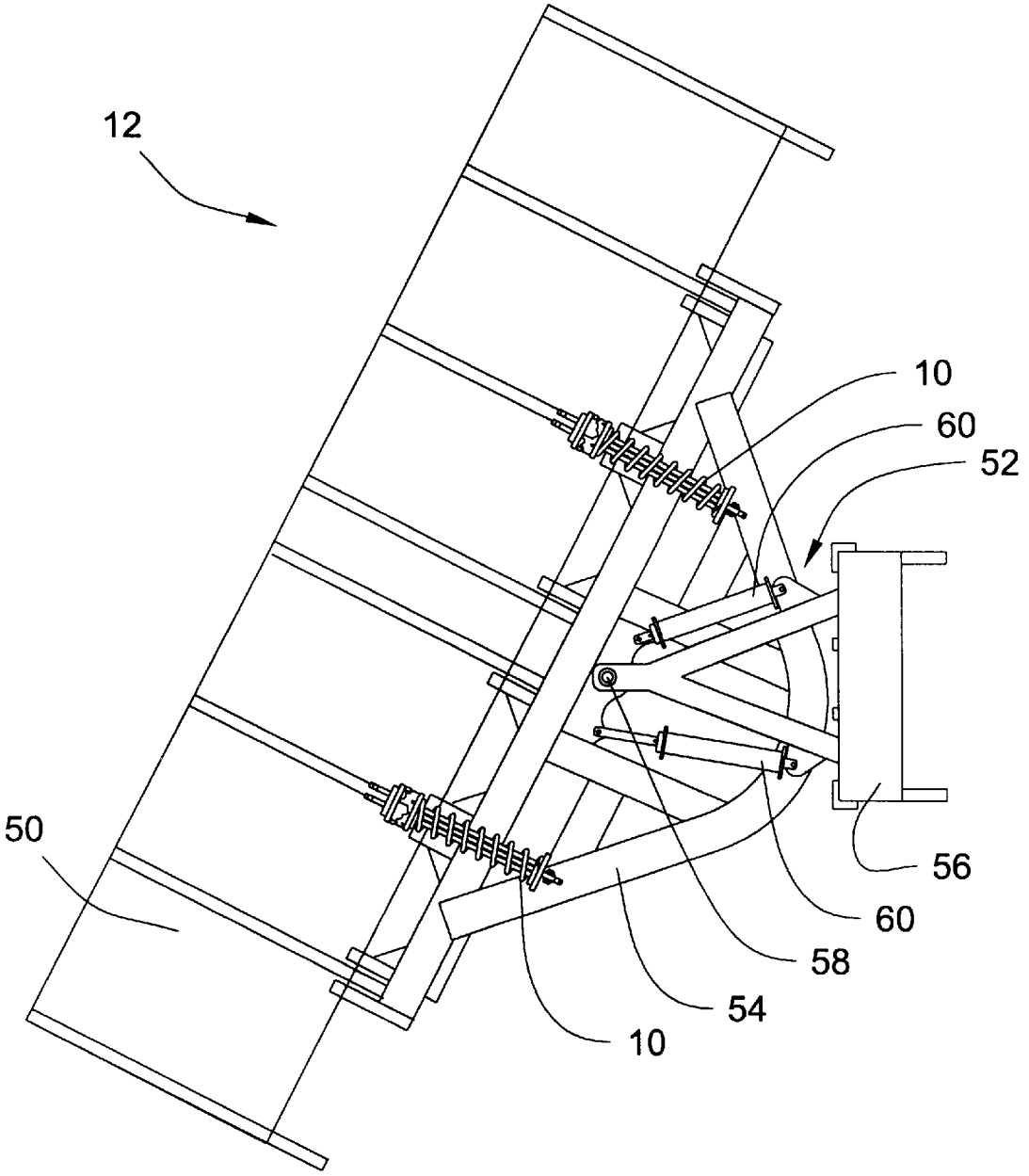
FIG. 3 is a plan view of a preferred snowplow system that includes the preferred biasing assembly illustrated in FIGS. 1, 2*a* and 2*b*.
Figure 4A:
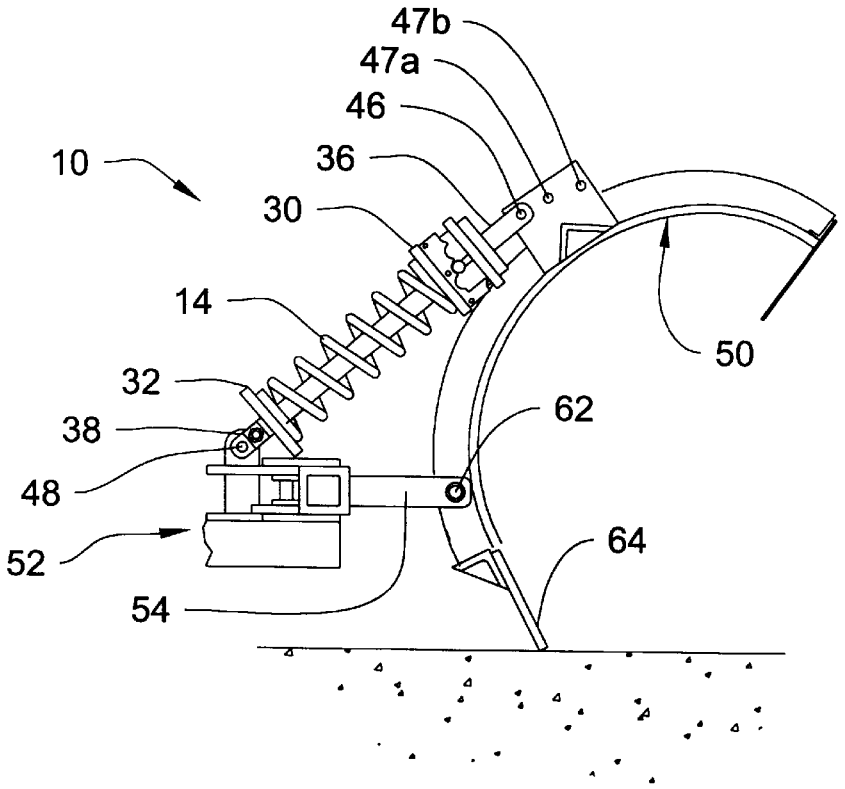
FIG. 4*a* is a side view of the preferred snow plow system of FIG. 3, showing the moldboard in a normal position.
Figure 4B:
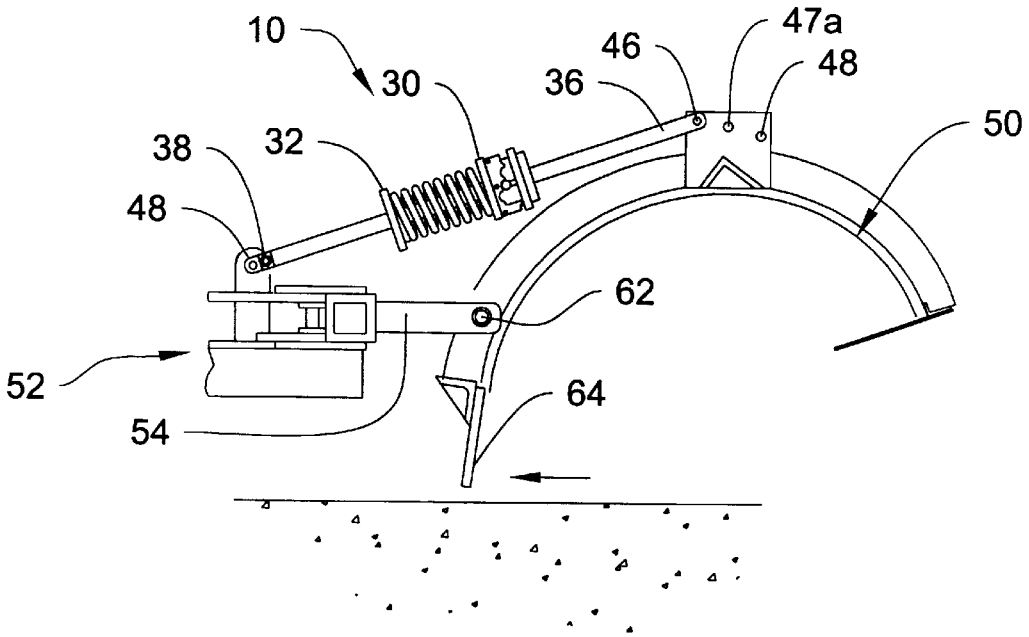
FIG. 4*b* is a side view of the preferred snow plow system of FIG. 3, showing the moldboard in the "tripped" or deflected position.

As illustrated in FIGS. 3, 4*a* and 4*b*, the preferred snowplow assembly 12 of the present invention includes a snowplow blade or moldboard 50 which is pivotally mounted to a frame. As will be appreciated by those skilled in the art, although the frame may comprise a single component, it preferably, and as shown in this embodiment, is comprised of multiple components. The frame depicted therein 52 includes a first frame component or A-frame 54 to which the moldboard 50 is mounted, and a second frame component or pushframe 56 which is adapted to be mounted to a vehicle (not shown). The precise configuration of the pushframe 56 will vary according to the type of vehicle onto which the assembly is to be mounted (e.g., tractor, light-duty or heavy-duty truck or "Bobcat"), and the location of the mounting (e.g., on the front of the vehicle or on the undercarriage). Those of ordinary skill, however, upon reading and understanding the disclosure provided herein, will be able to adapt the assembly so as to permit mounting in a variety of locations on a vehicle.

To enable the moldboard 50 to be adjustably pivoted about a generally vertical axis, the A-frame 54 is pivotally mounted to the pushframe 56 at a pivotal joint 58, as shown in FIG. 3. As FIG. 3 further illustrates, the A-frame 54 is selectively positionable relative to the pushframe 56 by a driving means, such as one or more hydraulic cylinders 60, as best shown in the plan view of FIG. 3. Such positionability of the A-frame 54 relative to the direction of movement of the vehicle is desirable for plowing snow in a desired manner and in a desired direction.

Referring now to FIGS. 4*a* and 4*b*, the moldboard 50 is also pivotally moveable along a horizontally longitudinal axis between a normal plowing position, shown in FIG. 4*a*, and a displaced position, shown in FIG. 4*b*. This pivoting of the moldboard 50 is commonly referred to as "tripping." Facilitating this movement, the moldboard 50 is pivotally mounted at its rear side to the A-frame 54 by a plurality of fasteners 62 (only one such fastener, in the form of a pin, being shown in FIGS. 4*a* and 4*b*). The tripping movement of the moldboard 50 occurs when a bottom edge 64 of the moldboard 50 strikes an object. When this occurs, the moldboard 50 and the A-frame 54, designed with a cooperating geometry, permit the bottom edge 64 of the moldboard 50 to move vertically rearwardly and upwardly relative to its normal position, thereby permitting the moldboard to ride over the object. This dissipates the force of the impact, and reduces the risk of damage to the assembly components, as well as to the vehicle.

For biasing the moldboard toward the normal plowing position (FIG. 4*a*), the snowplow assembly includes as least one biasing assembly operable to provide a biasing force between the moldboard 50 and the A-frame 54. In accordance with one significant aspect of the present invention, the biasing assembly is adjustable to exert a variable amount of biasing force upon the moldboard. In one preferred embodiment, the present invention provides a rotatable collar having a variable cam profile which engages against a fixed lug in one of a plurality of positions so as to affect the degree of axial compression of the spring, the spring functioning as a preferred biasing force. Rotation of the collar permits selective engagement of a different cam notch, each cam notch being associated with a respective predetermined amount of spring compression.

The availability of a relatively readily adjustable biasing force is of significant advantage to a vehicle operator. For example, the operator, after leaving a garage, may adjust the biasing force to compensate for a variety of surface conditions (e.g., gravel versus paved roadways), and changes in environmental conditions (increases in snowfall, and density of snow) quickly and, further, without having to disassemble the assembly or return to the garage for assistance.

Figure 2A:
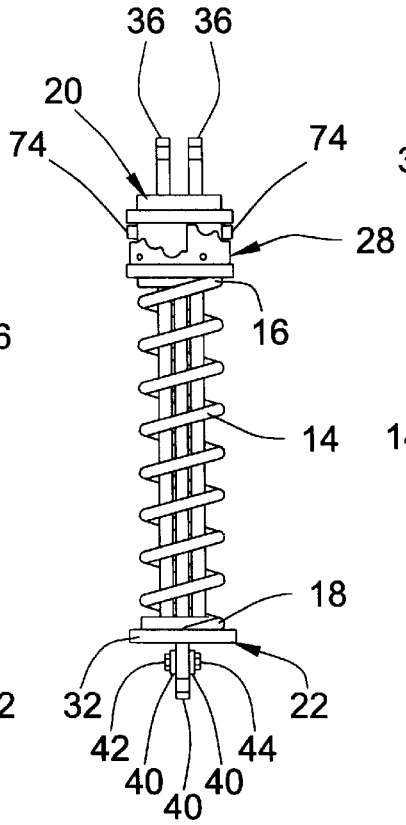
FIG. 2*a* is a front elevation view of the preferred biasing assembly shown in FIG. 1.
Figure 2B:
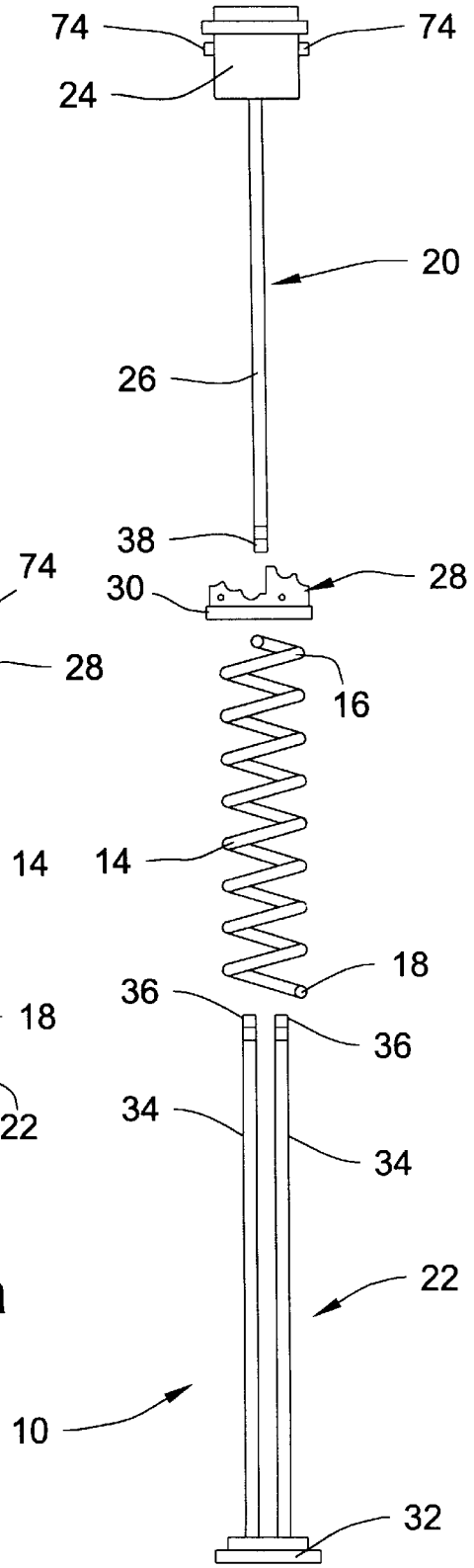
FIG. 2*b* is an exploded side elevation view of the preferred biasing assembly shown in FIGS. 1 and 2*a*.

A preferred embodiment of the biasing assembly 10, which is included in the snowplow assembly of the present invention, is illustrated in FIGS. 1, 2*a* and 2*b*. In particular, the biasing assembly 10 includes any suitable compressible biasing member, preferably a coil spring 14 as shown, having a first end 16 and an opposite second end 18. The first and second ends 16, 18 of the spring 14 are located between a first support member 20 and second support member 22, respectively. These first and second support members 20, 22 are further cooperatively shaped to interfit in a sliding manner, as will be described below in greater detail.

More particularly, and in the preferred embodiment depicted in FIGS. 1, 2*a* and 2*b*, the first support member 20 includes a generally cylindrical head structure 24. The first support member 20 also includes an elongate shaft 26 which is mounted to the first support member 20 and which extends along an axis through a center of the spring 14. Additionally, a generally circular collar 28 (shown also in FIG. 5*a*) is rotatably disposed around the cylindrical head 24, the collar 28 having a radially extending flange 30 which contacts the first end 16 of the spring 14.

The second support member 22 includes a disk-like flange 32 that contacts the second end 18 of the spring 14. Additionally, at least one shaft (not depicted), and advantageously a pair of elongate shafts 34 (shown), are mounted to this second support member 22, and are adapted to centrally extend through the spring 14 parallel to the elongate shaft 26 of the first support member 20. In the preferred embodiment depicted in FIGS. 2*a* and 2*b*, the shafts 34 are mounted with such spacing from each other to permit receipt of the elongate shaft 26 of the first support member 20 therebetween. It will be appreciated from this disclosure, of course, that the number of shafts mounted to the first and second support members may be varied so long as the operation of the inventive assembly is not compromised.

The first support member 20 is provided with at least one opening through which respective ends 36 of the shafts 34 of the second support member 22 may protrude. Likewise, the second support member 22 is provided with an opening through which an end 38 of the shaft 26 of the first support member 20 protrudes. The first support member 20 is thereby interfit to permit axial reciprocation relative to the second support member 22 along the axis of the spring 14, and thereby imparting compression to the spring 14 which resides between the respective first and second flanges 30 and 32.

When the biasing assembly 10 is in its assembled state, its travel is limited by locking members 40 mounted near the end 38 of the shaft 26 of the first support member 20 below the flange 32. More particularly, the locking members 40 may be rectangular shaped and secured in a stacked manner on opposite sides of the shaft 26 with a nut 42 and bolt 44. When mounted, the stacked locking members 40 are dimensioned wider than the opening in the flange 32 through which the shaft 20 extends, limiting movement of flange 32 relative to the shaft 26.

In order to provide for the biasing assembly 10 to bias the moldboard 50 toward the normal plowing position (as shown in FIG. 4*a*), the shaft ends 36 of the second support member 22 are connected to provide leverage against the moldboard 50. More particularly, and as illustrated in FIGS. 4*a* and 4*b*, the ends 36 are preferably connected via a pin connection 46 to the moldboard 50 at a position substantially upward from the pivotal pin 62 which connects the moldboard 50 to the A-frame 54. Several additional attachment positions (e.g., 47*a, b*) may be provided on the moldboard to allow for additional adjustment. Further, the shaft end 38 of the first support member 20 is mounted to the A-frame 54 at another pin connection 48. Accordingly, the oppositely disposed flanges 30 and 32 of the first and second support members 20 and 22, respectively, will move toward each other when the moldboard 50 is pivoted from the normal position (FIG. 4*a*) toward the displaced position (FIG. 4*b*), correspondingly increasing the amount of compression of the spring 14.

Figure 5A:
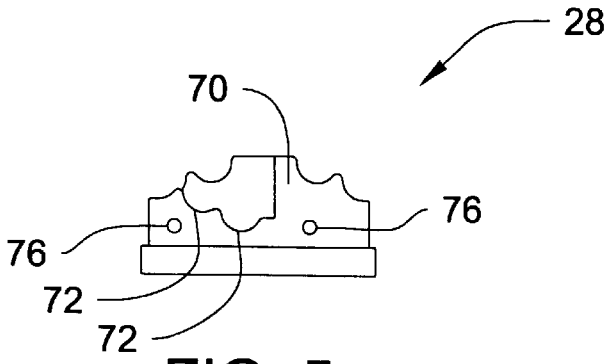
FIG. 5*a* is an elevation of a collar from the preferred biasing assembly illustrated in FIGS. 1, 2*a* and 2*b*.
Figure 5B:
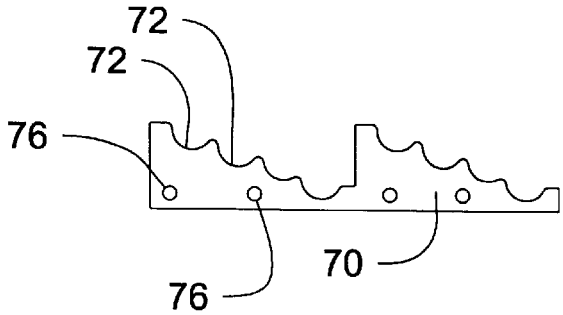
FIG. 5*b* is a side view of the notch guide profile which forms a portion of the collar of FIG. 5*a* in a flat configuration.

In accordance with a significant aspect of the present invention, the amount of bias provided by the biasing assembly 10 is adjustable. More specifically, the degree of biasing force can be selectively adjusted by rotating the collar 28 relative to the head 24 (see, e.g., FIG. 2*b*). As shown in FIG. 5*a*, the collar 28 is preferably cylindrical, and will comprise at least one, and preferably (as shown) two indentical and opposing, cam-type profiles. If two such profiles are used, they should be disposed at approximately 180° from each other, as shown in FIG. 5*a*. Each of the profiles 70 is formed by a series of notches 72 arranged in a vertically stepped manner (as shown in FIG. 5*b*). These notches will interfit with at least one lug, and preferably (as shown in FIGS. 1, 2*a* and 2*b*) a pair of oppositely disposed circular lugs 74. These lugs are mounted so as to radially extend from the head 24. In this configuration, the flange 30 of the collar 28 presses against the first end 16 of the spring 14, urging the collar 28 upwardly so that the lugs 74 respectively engage into selected notches 72. Rotation of the collar 28 relative to the first support member 20 causes the lugs 74 to be supported in correspondingly different notches 72. Because each such notch position is associated with a particular amount of distance between the flanges 30, 32 (and thus a particular amount of spring compression), the amount of predetermined spring compression may be readily varied depending on the notch 72 selected.

Of course, the number of notches may be varied depending on the degree of adjustment desired. Further, a second rotatable collar may be provided on the other end of the biasing assembly to provide additional biasing adjustment.

Figure 6:
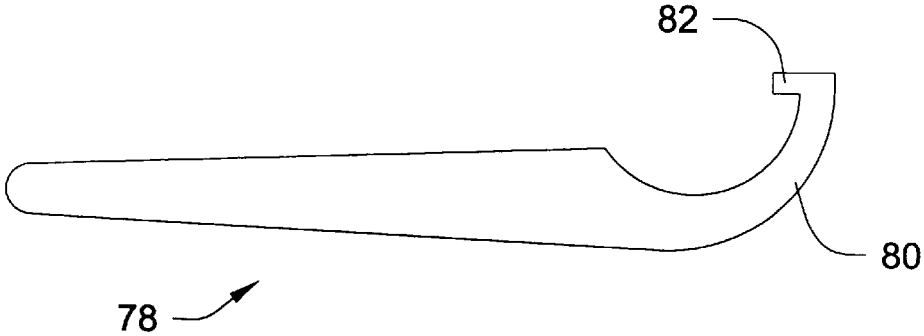
FIG. 6 is a plan view of a tool useful for rotating the collar.
Figure 7:
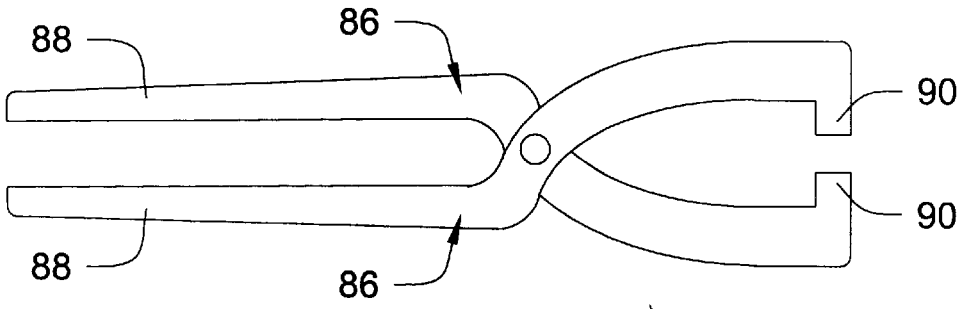
FIG. 7 is a plan view of another tool useful for rotating the collar.

The collar 28 may be readily rotated manually with the aid of an associated tool. For example, the collar 28 illustrated in FIG. 5*a* has a plurality of holes 76 which may be engaged by a tool 78 shown in FIG. 6. The tool 78 of FIG. 6 has an arcuate end 80 shaped to partially extend around the collar 28. The arcuate end 80 has an inwardly directed tooth 82 which is received in one of the holes 76, gripping the collar 28 so that it may be rotated. FIG. 7 illustrates a tong-like tool 84 that can also be used to turn the collar 28, the tool 84 having pivotally connected first and second tong members 86, each of the tong members 86 having a handle 88 and gripping teeth 90. The handles 88 may be squeezed together to firmly grip opposite holes 76 in the collar 28.

Figure 8A:
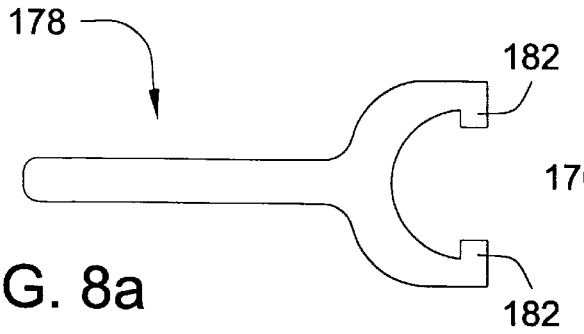
FIG. 8*a* is a plan view of a tool useful for rotating a collar as illustrated in the plan view of FIG. 8*b*, the collar having at least one pair of opposed notches in its outer periphery.
Figure 8B:
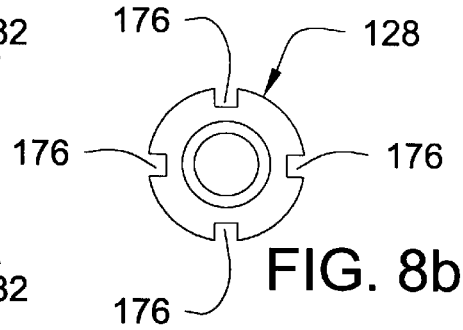
Figure 9A:
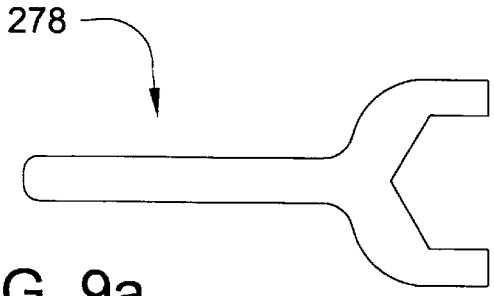
FIG. 9*a* is a plan view of a tool useful for rotating a collar as illustrated in the plan view of FIG. 9*b*, the collar having a hex-shaped outer periphery.
Figure 9B:
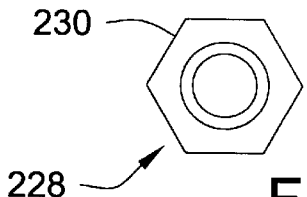
Figure 10:
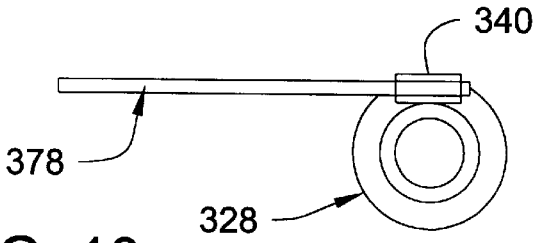
FIG. 10 is a plan view of a rod-shaped tool and associated collar with a radially-aligned tubular socket adapted to receive the tool to permit rotation of the collar.
Figure 11:
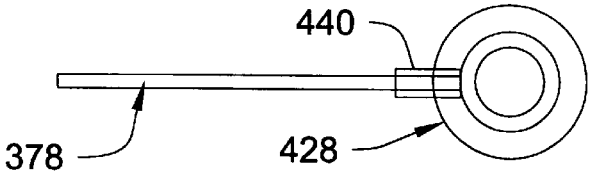
FIG. 11 is a plan view of a rod-shaped tool and associated collar with a tangentially-aligned tubular socket adapted to receive the tool to permit rotation of the collar.

As illustrated in FIGS. 8*a*, 8*b*, 9*a*, 9*b*, 10 and 11, various collars and respectively associated tools may be used to rotate the collar. FIG. 8*a* illustrates a one-piece tool 178 having a pair of inwardly-disposed teeth 182. The teeth 182 may be engaged in a selected pair of cooperatively-shaped recesses 176 oppositely recessed in a periphery of a flange 130 of an associated collar 128 shown in FIG. 8*b*. FIG. 9*a* shows a tool 278 useful for adjustably rotating a collar 228 illustrated in FIG. 9*b* which has a flange 230 with a hex-shaped outer periphery. FIG. 10 shows a rod-shaped tool 378 and an associated collar 328. The collar 328 has a radially-aligned tubular socket 340 for receiving the tool 378. FIG. 11 shows the rod-shaped tool 378 being used with a collar 428 having a tangentially-aligned tubular socket 440.

While the invention is described herein in connection with certain preferred embodiments, there is no intent to limit the present invention to those embodiments. On the contrary, it is recognized that various changes and modifications to the described embodiments will be apparent to those skilled in the art, and that such changes and modifications may be made without departing from the spirit and scope of the present invention. Accordingly, the intent is to cover all alternatives, modifications, an equivalents included within the spirit and scope of the invention as defined by the appended claims.

All patents identified herein are incorporated by reference.

What is claimed is:

1. A snowplow assembly comprising:

a frame;

a moldboard pivotally mounted to the frame for movement between a normal position and a displaced position; and at least one biasing assembly biasing the moldboard toward the normal position with a biasing force comprising a compressible biasing member having first and second ends;

a first support member secured for movement with the moldboard;

a second support member secured to the frame; and a rotatable collar supporting the first end of the biasing member and positioned between an associated one of the support members and the biasing member, the other support member supporting the second end of the biasing member, wherein a pivoting movement of the moldboard away from the normal position causes a corresponding increase in compression of the biasing member, and wherein movement of the rotatable collar relative to the associated support member varies the compression of the biasing member.

2. A snowplow assembly according to claim 1, wherein said collar is rotatably disposed around said associated support member, said collar having a generally stepped profile providing a plurality of notches at various axial depths, said collar seating against said associated support member at a selected one of the notches depending on the rotational position of the collar, each notch providing a corresponding axial position of the collar relative to said associated support member and a corresponding degree of compression of the biasing member.

3. A snowplow assembly according to claim 1, wherein the biasing member is a spring.

4. A snowplow assembly according to claim 3, wherein the spring is coil-shaped.

5. A snowplow assembly according to claim 1, wherein said collar and support members are limited in relative movement with regard to one another so that said biasing member is in a compressed configuration to provide said biasing force of a predetermined magnitude when said moldboard is in the normal position.

6. A snowplow assembly according to claim 1, wherein said collar has a shape adapted to be engaged by a tool for rotating the collar to a selected position.

* * * * *